US005426352A

United States Patent [19]

Styfhoorn et al.

[11] Patent Number: 5,426,352

[45] Date of Patent: Jun. 20, 1995

[54] AUTOMATIC HONING APPARATUS

[75] Inventors: John Styfhoorn, Dunlap; Ronald C. Beal, Pekin, both of Ill.

[73] Assignee: Caterpillar Inc., Peoria, Ill.

[21] Appl. No.: 129,273

[22] Filed: Sep. 30, 1993

[51] Int. Cl.[6] ..... B24B 5/08

[52] U.S. Cl. ..... 318/3; 318/569; 451/27

[58] Field of Search ..... 318/3–5, 318/567–569; 451/14, 27, 156

[56] References Cited

U.S. PATENT DOCUMENTS

| | | | |
|---|---|---|---|
| 3,404,490 | 10/1968 | Estabrook | 451/27 |
| 3,601,930 | 8/1971 | Robillard | 451/14 |
| 3,736,703 | 6/1973 | Estabrook et al. | 451/14 |
| 4,145,845 | 3/1979 | Ebelt | 451/27 |
| 4,423,567 | 1/1984 | Raven, III | 451/124 |
| 4,455,789 | 6/1984 | Gehring | 451/156 |
| 4,512,116 | 4/1985 | Vanderwal, Jr. et al. | 451/479 |
| 4,816,731 | 3/1989 | Boulton et al. | 318/569 |
| 4,823,061 | 4/1989 | Bouton et al. | 318/603 |
| 4,887,221 | 12/1989 | Davis et al. | 364/474.23 |

*Primary Examiner*—William M. Shoop, Jr.
*Assistant Examiner*—Brian Sircus
*Attorney, Agent, or Firm*—Claude F. White

[57] ABSTRACT

An automatic honing apparatus for honing the internal surface of a cylindrical member has a wheel member for tightening the honing stones against the internal surface. A brake assembly is associated with the wheel member, and when activated contacts the wheel member and when de-activated releases the wheel member. A sensing device detects the load on a first motor and activates or de-activates the brake assembly in response to preset motor load values. As the load on the first motor increases and decreases, the sensing device cycles the brake on and off to tighten the honing stones. A second motor drives a carriage assembly forward and backward to run the honing stones in and out of the cylindrical member to hone the entire internal surface of the cylindrical member.

20 Claims, 6 Drawing Sheets

AUTOMATIC HONING APPARATUS

TECHNICAL FIELD

This invention relates generally to an automatic load sensing system and more particularly to an automatic honing apparatus for sensing the load on a motor and tightening the honing stones in response to detection of a predetermined load on the motor.

BACKGROUND ART

Earthmoving and construction machines utilize a plurality of hydraulic cylinders to perform various work functions. Periodical service and maintenance of the hydraulic cylinders requires a honing operation of the cylindrical bores to remove scratches and gouges from the bore surface. The honing operation ensures that the piston seals will not be damaged and that little or no leakage past the piston seals will occur.

Various types of manually operated honing systems are available and are in use for manually honing the bores of hydraulic cylinders. Although these manual honing systems generally operate satisfactorily, they require considerable time and significant effort by the operator. Automatic honing systems are also known and used. However, these automatic systems are generally quite complicated and costly, which makes them prohibitive for many service and repair shops.

The present invention is directed to overcoming one or more of the problems as set forth above.

DISCLOSURE OF THE INVENTION

In one aspect of the present invention, an automatic honing apparatus for honing the internal walls of a cylindrical member includes a honing assembly having a head portion having a plurality of honing stones, a wheel member for adjusting the stones, and a first shaft connecting the wheel member and the head portion. The automatic honing system further includes a motor and a second shaft connecting the motor to the wheel member. Still further, the automatic honing apparatus includes means for sensing the load on the motor, a brake assembly associated with the wheel member, and means for activating and de-activating the brake assembly in response to a signal from the sensing means.

During routine maintenance and repair of earthmoving and construction machines, the hydraulic cylinders are often disassembled so the cylinder bores can be honed to remove scratches and other surface irregularities. Although this honing operation is a good maintenance procedure, it is often costly, time consuming, and an unpleasant task for the laborer. The subject automatic honing apparatus provides a simple, reliable, inexpensive, and highly efficient honing system which saves time, effort, and capital outlay.

BEST MODE FOR CARRYING OUT THE INVENTION

Figure 1:
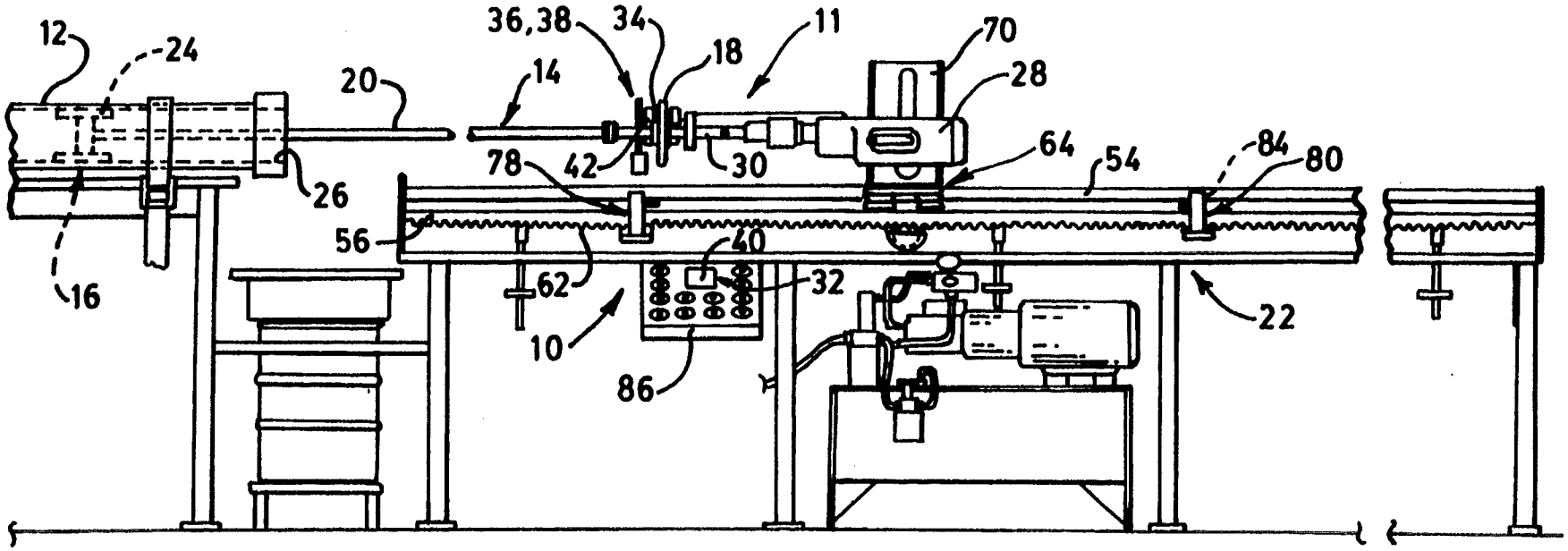
FIG. 1 is a diagrammatic side elevational view of the subject automatic honing apparatus in place on a support assembly with a hydraulic cylinder also on the support assembly.
Figure 2:
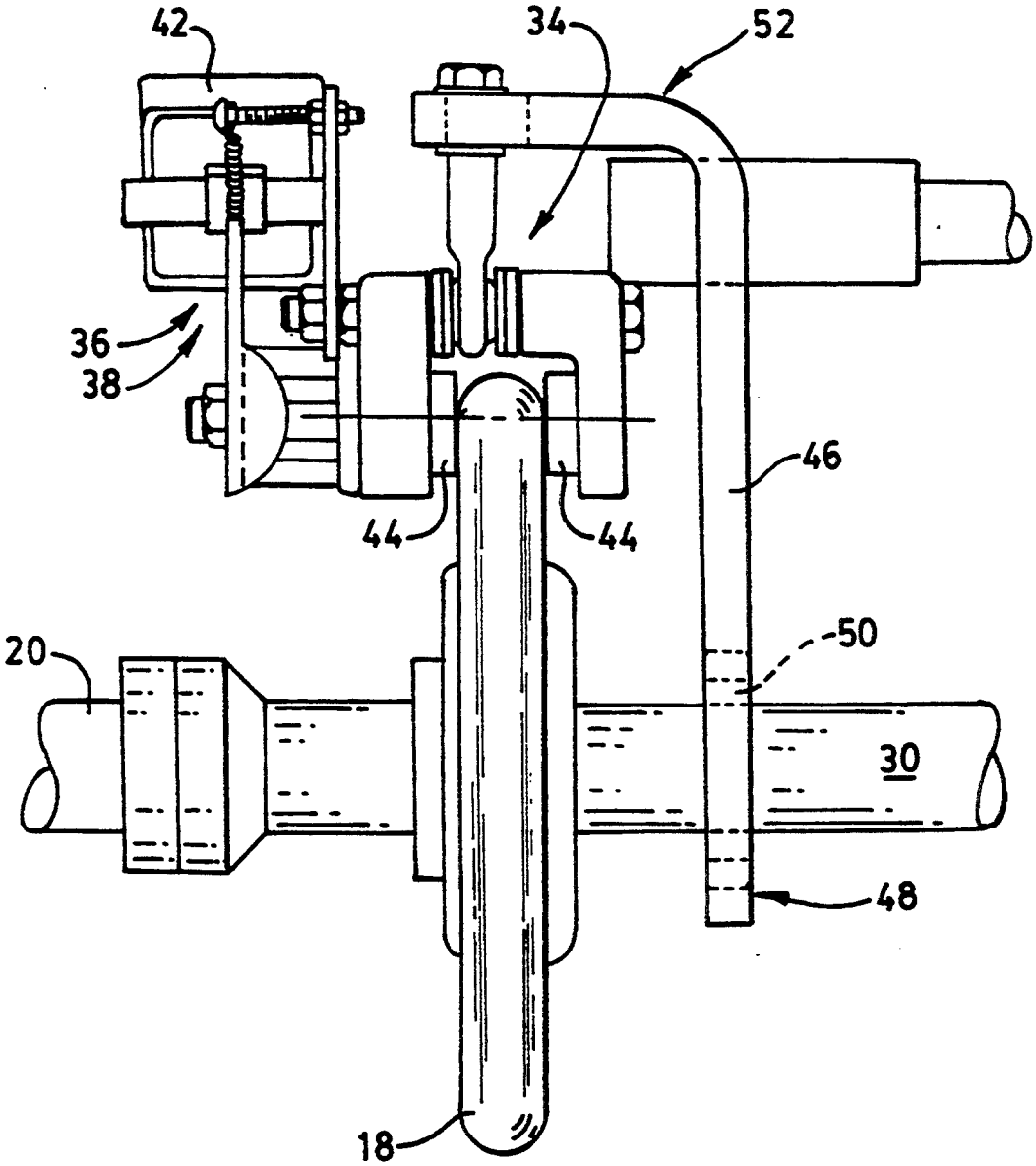
FIG. 2 is a diagrammatic enlarged plan view of a portion of the automatic honing apparatus of FIG. 1 and showing a brake assembly.
Figure 3:
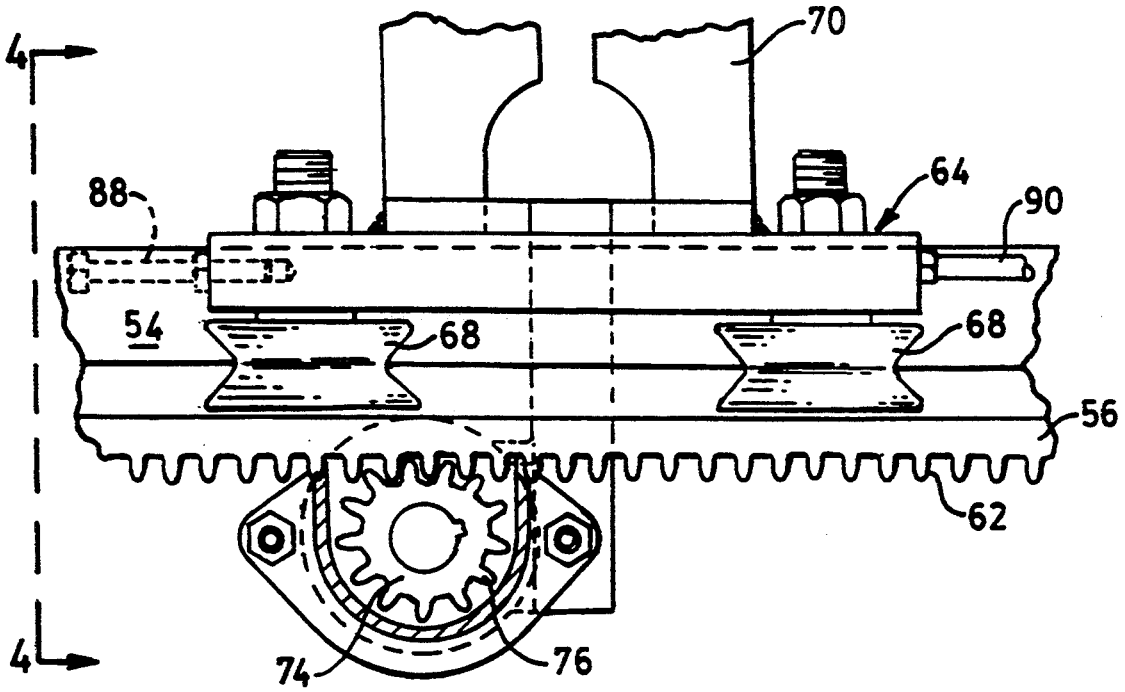
FIG. 3 is a diagrammatic enlarged side elevational view of a carriage assembly of the subject invention.
Figure 4:
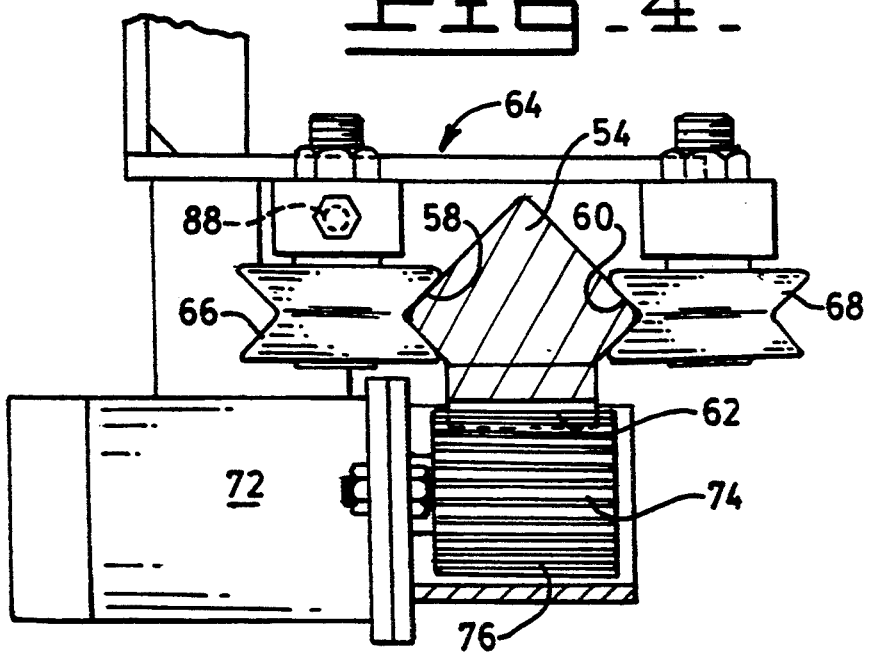
FIG. 4 is a diagrammatic enlarged cross-sectional view taken generally along the lines 4—4 of FIG. 3.
Figure 5:
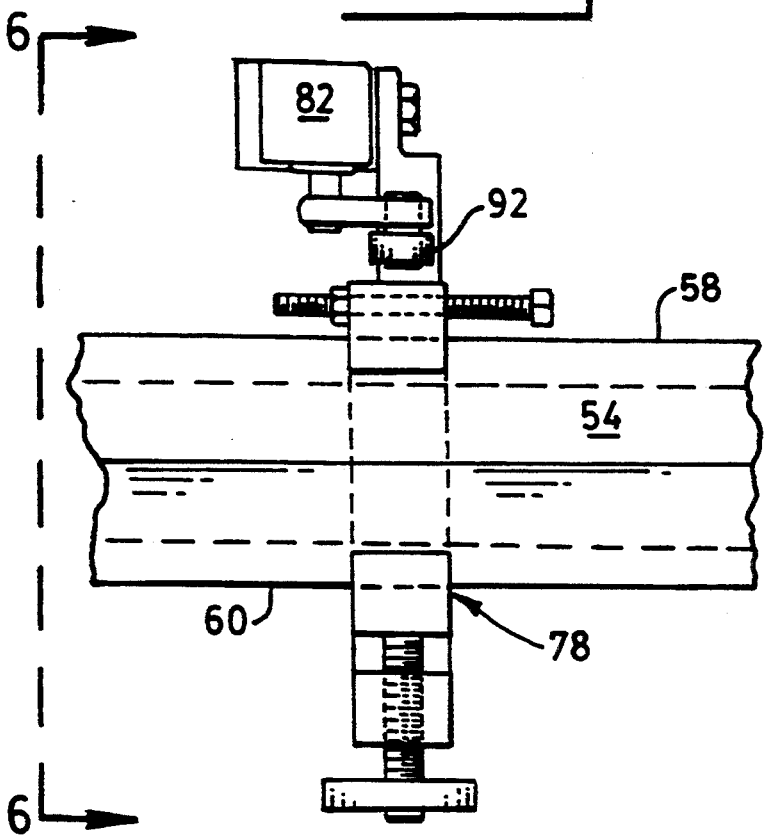
FIG. 5 is a diagrammatic enlarged plan view of a limit switch of the subject invention.
Figure 6:
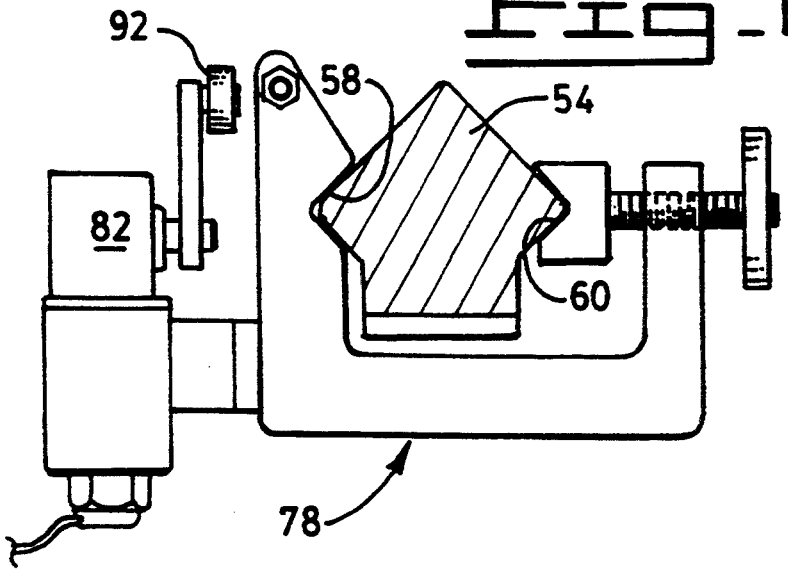
FIG. 6 is a diagrammatic enlarged cross-sectional view taken generally along the lines 6—6 of FIG. 5.

Referring to the drawings, an automatic load sensing system 10 for an automatic honing apparatus 11 for honing the internal walls of a cylindrical member 12 includes a honing assembly 14 having a head portion 16, a wheel member 18, and a first shaft 20 which connects the wheel member 18 and the head portion 16. The honing apparatus 11 and the cylindrical member 12 are supported on a table or support assembly 22 such that the head portion 16 is substantially axially aligned with the cylindrical member 12. The head portion 16 includes a plurality of adjustable honing stones 24 which are adapted to enter the open end 26 of the cylindrical member 12 and contact the internal surface walls. The wheel member 18 is adapted to adjust the stones 24 in a manner which is well known in the honing art.

The automatic honing apparatus 11 further includes a first motor 28, a second shaft 30 connecting the motor 28 to the wheel member 18, means 32 for sensing the load on the motor 28 when it is rotating, and a brake assembly 34 positioned adjacent to and associated with the wheel member 18. The first motor 28 is adapted to rotate first and second shafts 20,30, the wheel member 18, and the head portion 16, which includes the honing stones 24. The automatic honing apparatus 11 also includes means 36 for activating the brake assembly 34 and means 38 for de-activating the brake assembly 34. The brake assembly 34 is activated in response to the sensing means 32 sensing a first predetermined load on the first motor 28, and is de-activated in response to the sensing means 32 sensing a second predetermined load on the first motor 28.

The first motor 28 can be an electrically operated motor or a hydraulically operated motor. When the first motor 28 is an electrically operated motor, the sensing means 32 includes an ammeter controller 40 which is electrically connected to the motor 28 and to the activating means 36 and the de-activating means 38. The activating means 36 includes a solenoid 42 and an electrical signal generated by the ammeter controller 40 and communicated to the solenoid 42. The de-activating means 38 also includes the solenoid 42 and the interruption of the electrical signal from the ammeter controller 40 to the solenoid 42. The ammeter controller 40 is adapted to sense the amperage being used by the electric motor 28 and transmit a signal to the solenoid 42 when the amperage reaches a first predetermined and presetable value. The signal activates the solenoid 42 which then activates the brake assembly 34 to which it is connected. When the amperage being used by the motor reaches a second predetermined and presetable higher value, the ammeter controller 40 senses this second higher amperage value and dis-continues the electrical signal being transmitted to the solenoid 42. The solenoid 42 is de-activated and the brake assembly released from engagement with the wheel member 18.

The brake assembly 34 has brake pads 44 which are adapted to contact and apply pressure to the wheel member 18 for tightening the honing stones 24. A first bracket 46 has a first end portion 48 connected by a bearing 50 to the second shaft 30. The first bracket 46 has a second end portion 52, and the brake assembly 34 and the solenoid 42 are connected to and supported by the second end portion 52.

The support assembly 22 includes an elongated beam 54 and an elongated rack 56 connected to the beam 54. The beam 54 has first and second rail portions 58,60 and the rack 56 has a plurality of teeth 62. A carriage assembly 64 is mounted for fore and aft movement on the beam 54, and includes a plurality of first rollers 66 and a plurality of second rollers 68. The first rollers 66 are engageable with the first rail portion 58 and the second rollers 68 are engageable with the second rail portion 60. A second bracket 70 is connected to the carriage assembly 64 and the electric motor 28 is vertically adjustably connected to the second bracket 70. The electric motor 28 is illustrated as a heavy duty high torque variable speed drill, although other types of electric or hydraulic motors can be used. A high torque reversible hydraulic motor 72 is also connected to the carriage assembly 64, and includes a pinion 74 having a plurality of teeth 76. The pinion teeth 76 mate with the rack teeth 62 and move the carriage assembly along the rack 56 when the hydraulic motor 72 is activated.

First and second carriage stop assemblies 78,80 are connected to the support assembly 22 and are movable to a plurality of positions along the support assembly 22. The first carriage stop assembly 78 is positioned forwardly of the carriage assembly 64 and the second carriage stop assembly 80 is positioned rearwardly of the carriage assembly 64. First and second limit switches 82,84 are connected respectively to the first and second carriage stop assemblies 78,80 and are adapted to limit respectively the forward and rearward movement of the carriage assembly 64 along the support assembly 22. The limit switches 82,84 are in communication with a control panel 86 and with the hydraulic motor 72 to cause the hydraulic motor 72 to reverse its driving direction. The limit switches 82,84 are activated by first and second rods or shafts 88,90 which are connected to the carriage assembly 64 and are adapted to contact a switch arm 92 on each of the limit switches 82,84.

Figure 7:
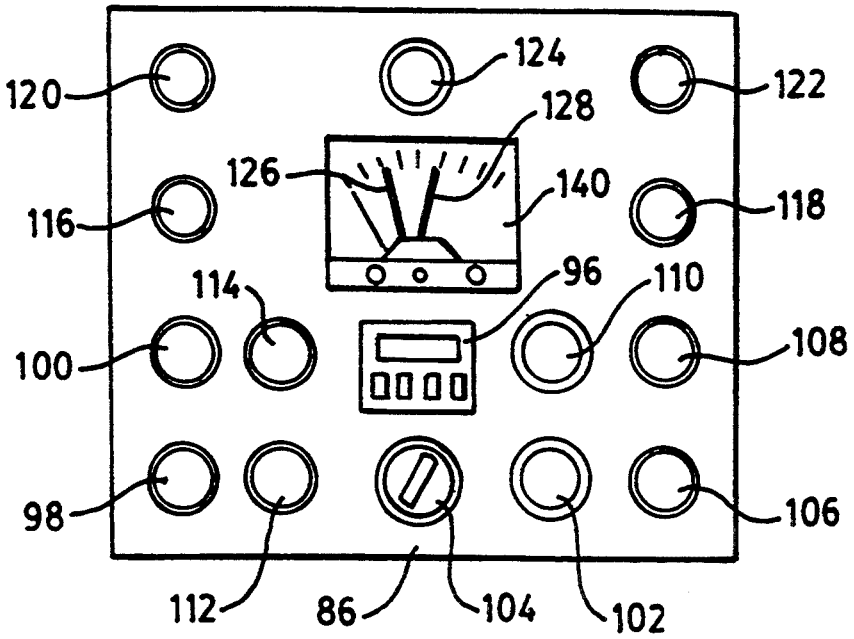
FIG. 7 is a diagrammatic enlarged plan view of a control panel of the present invention.

With particular reference to FIG. 7, the control panel 86 has a plurality of control switches or buttons, indicating lights, the ammeter controller 40, and a timer 96. All of the functions of the honing system 10 are controlled by the control panel 94. A control button 98 turns the automatic cycle of the honing system on and a button 100 turns the automatic cycle off. However, to activate the automatic honing cycle, a button 102 must be activated at the same time as button 98. Prior to activating the automatic cycle buttons 98,102, a button 112 is activated to start the motor 28. The timer 96 can be set to control the duration of time of the automatic honing cycle and turns off all power to the honing apparatus 11 when it times out. A switch 104 turns the timer on and off. Buttons 106 and 108 turn the hydraulic system on and off respectively. A button 110 controls flow of hydraulic honing oil to the hydraulic cylinder 12. In addition to the buttons and switches controlling the automatic functioning of the honing apparatus 11, the control panel 94 also has buttons for controlling the honing system 10 in a manual mode. Buttons 112 and 114 manually control the power on and power off respectively to the electric motor 28, and buttons 116 and 118 control manual movement of the carriage assembly forward and rearward respectively. Lights 120 and 122 indicate when the carriage is moving forwardly or rearwardly respectively. An emergency stop button 124 shuts off all control functions. The ammeter controller 40 has first and second setable hands 126,128 which are adjustable to sense the first and second amperage loads respectively on the motor 28.

Figure 10:
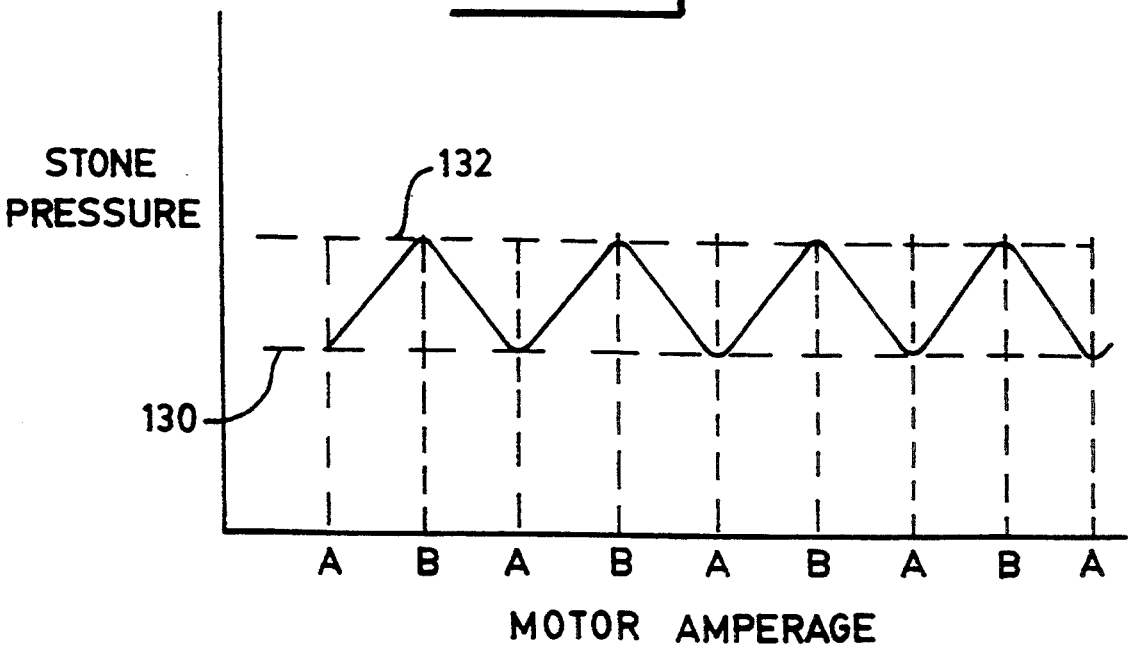
FIG. 10 is a chart illustrating the sequencing of activation and de-activation of the brake assembly of the present invention.

With particular reference to FIG. 10, a simple chart illustrates how the pressure on the honing stones 24 cycles up and down with respect to the amperage being used by the electric motor 28. Point A represents a first predetermined amperage load on the motor 28 and Point B represents a second higher predetermined load on the motor 28. Line 130 represents a certain pressure on the honing stones 24 when the motor amperage is at Point A, and line 132 represents a certain higher pressure on the stones 24 when the motor amperage is at Point B. As shown, the pressure on the stones 24 cycles between lines 130 and 132 as the motor amperage changes from A to B. The stone pressure is automatically changed by the automatic honing apparatus 11 as it activates and de-activates the solenoid 42 and the brake assembly 34.

Figure 8:
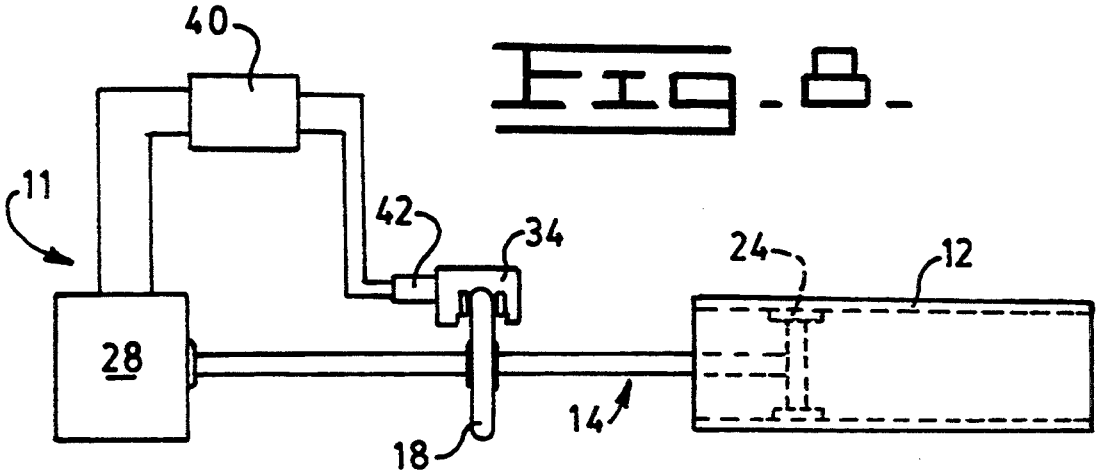
FIG. 8 is a schematic drawing of an automatic honing apparatus utilizing an electric motor.
Figure 9:
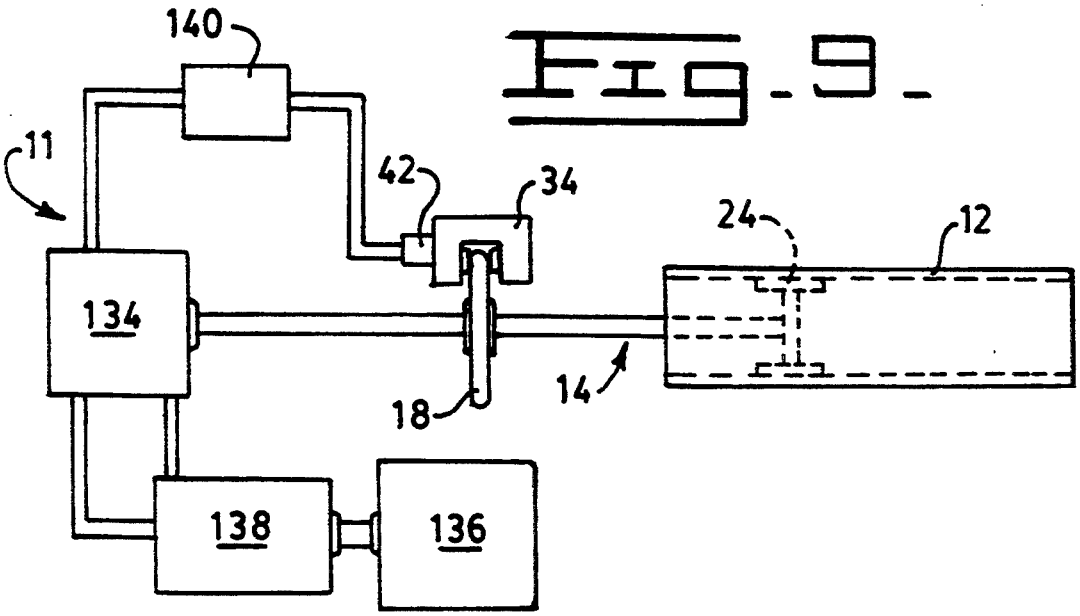
FIG. 9 is a schematic drawing similar to FIG. 8 but showing a hydraulic motor utilized in the automatic honing apparatus.

With particular reference to FIGS. 8 and 9, two simple schematic drawings illustrate respectively an automatic honing apparatus 11 having an electric motor 28 for driving the honing assembly 14, and a hydraulic motor 134 for driving the honing assembly 14. In the FIG. 8 embodiment, the ammeter controller 40 senses the amperage being used by the electric motor 28 and activates or de-activates the solenoid 42 and the brake assembly 34 at predetermined and preset amperage values. The brake assembly 34 acts on the wheel member 18 to tighten the honing stones 24. In the FIG. 9 embodiment, an electric motor 136 drives a hydraulic pump 138 which supplies hydraulic power to the hydraulic motor 134 which drives the honing assembly 14. A pressure meter controller 140 senses the hydraulic pressure in the hydraulic motor 134 and activates or de-activates the solenoid 42 and the brake assembly 34 at predetermined and preset pressure values. The brake assembly 34 acts on the wheel member 18 to tighten the honing stones 24.

INDUSTRIAL APPLICABILITY

With reference to the drawings, the subject automatic load sensing system 10 and the automatic honing apparatus 11 are particularly useful for automatically honing the internal wall surface of a hydraulic cylinder 12. Periodical maintenance and service of hydraulic cylinders requires that the internal wall surface be honed to remove scratches and other imperfections. Prior art manually operated honing apparatus requires considerable time and operator effort. The subject automatic honing apparatus 11 performs the honing operation in an efficient manner with no operator control or input, other than the initial activation of the apparatus.

Prior to starting the automatic honing cycle, an operator presets the desired honing time on the timer 96 on the control panel 86, and also sets the first and second hands 126,128 for low and high amperage on the ammeter controller 40. The operator then turns the timer switch 104 to ON, presses the hydraulic on button 106, the honing oil button 110, the electric motor button 112, and activates the automatic buttons 98 and 102. The automatic cycle then starts and the operator can leave the machine to attend to other work functions. The automatic honing cycle will continue until the timer 96 times out and shuts down the entire operation.

As the automatic cycle begins, the electric motor 28 rotates the honing stones 24 within the hydraulic cylinder 12, and the hydraulic motor 72 moves the carriage assembly 64 forward and backward on the rack 56. As the carriage assembly 64 moves, the honing stones 24 are moved in and out of the cylinder 12 to hone the entire length of the cylinder 12. When the amperage of the electric motor 28 is at or below the first set point on the ammeter controller 40, the ammeter controller activates the solenoid 42 and the brake assembly 34 to tighten the honing stones 24. The increased pressure on the honing stones 24 causes the amperage on the electric motor 28 to increase until it reaches the second, or higher, set point on the ammeter controller 40. At this point, the ammeter controller 40 discontinues the signal to the solenoid 42 and the brake assembly 34 is released from contact with the wheel member 18. The brake assembly continues to cycle on and off as the amperage of the electric motor 28 cycles between the two predetermined and preset values.

Other aspects, objects, and advantages of this invention can be obtained from a study of the drawings, the disclosure, and the appended claims.

We claim:

1. An automatic honing apparatus for honing the internal walls of a cylindrical member, said honing system and said cylindrical member being supported by a support assembly, said honing system comprising:

a honing assembly having a head portion including a plurality of adjustable honing stones, a wheel member for adjusting the stones, and a first shaft connecting the wheel member and the head portion;

a first motor;

a second shaft connecting said motor to said wheel member;

means for sensing the load on said motor when said motor is rotating;

a brake assembly associated with said wheel member;

means for activating said brake assembly in response to said sensing means sensing a first predetermined load on said motor; and means for de-activating said brake assembly in response to said sensing means sensing a second predetermined load on said motor.

2. A honing apparatus, as set forth in claim 1, wherein said sensing means includes an ammeter controller electronically connected to said motor and to said activating means.

3. A honing apparatus, as set forth in claim 1, wherein said brake assembly includes brake pads positioned adjacent said wheel member, and said means for activating said brake assembly includes a solenoid.

4. A honing apparatus, as set forth in claim 1, wherein said sensing means includes an ammeter controller electrically connected to said motor and to said de-activating means.

5. A honing apparatus, as set forth in claim 1, wherein said activating means includes a solenoid and an electrical signal generated by said sensing means and communicated to said solenoid.

6. A honing apparatus, as set forth in claim 2, wherein said activating means includes a solenoid and an electrical signal generated by said ammeter controller and communicated to said solenoid.

7. A honing apparatus, as set forth in claim 1, wherein said de-activating means includes a solenoid and the interruption of an electrical signal from said sensing means to said solenoid.

8. A honing apparatus, as set forth in claim 2, wherein said de-activating means includes a solenoid and the interruption of an electrical signal from said ammeter controller to said solenoid.

9. A honing apparatus, as set forth in claim 1, wherein said first motor is an electrical motor and said sensing means includes an ammeter controller for sensing the amperage used by said electrical motor.

10. A honing apparatus, as set forth in claim 1, wherein said first motor is a hydraulic motor and said sensing means includes a pressure meter controller for sensing the hydraulic pressure supplied to said hydraulic motor.

11. A honing apparatus, as set forth in claim 1, including a rack associated with said support assembly, a second motor, and a pinion connected to said second motor and engageable with said rack.

12. A honing apparatus, as set forth in claim 1, including a movable carriage assembly mounted on said support assembly, said first motor being connected to said carriage assembly.

13. A honing apparatus, as set forth in claim 12, including a rack connected to said support assembly, a second motor connected to said carriage assembly, and a pinion connected to said second motor and engageable with said rack.

14. A honing apparatus, as set forth in claim 1, including a first bracket connected to one of said first and second shafts, said brake assembly being connected to said bracket.

15. A honing apparatus, as set forth in claim 12, including a second bracket connected to said carriage assembly, said first motor being connected to said second bracket and adjustable thereon.

16. A honing apparatus, as set forth in claim 13, including first and second limit switches connected to said support assembly, said limit switches being adapted to limit respectively the forward and backward movement of said carriage assembly along said support assembly.

17. A honing apparatus, as set forth in claim 16, wherein said first and second limit switches are movable to a plurality of positions along the support assembly.

18. A honing apparatus, as set forth in claim 1, including a control panel having a plurality of control switches and a timer, at least one of said switches being adapted to place the honing system in an automatic operation cycle mode including forward and backward travel of said carriage assembly and sequential activation and de-activation of said brake assembly, and said timer being adapted to control the duration of time of said automatic cycle.

19. A honing apparatus for honing the internal surface of a cylindrical member, comprising:

a honing assembly having a head portion including a plurality of adjustable honing stones, a wheel member for adjusting the stones, and a first shaft connecting the wheel member to the head portion;

a support frame assembly for supporting said cylindrical member and said honing assembly;

a first motor for rotating the head portion;

a second shaft connecting the first motor to said wheel member;

a brake assembly positioned adjacent said wheel member;

a solenoid connected to said brake assembly; and an ammeter controller electronically connected to said first motor and to said solenoid for sensing the amperage used by said first motor for activating and de-activating said solenoid in response to said ammeter controller sensing respective first and second predetermined and presetable amperage loads on said first motor.

20. An automatic load sensing system for increasing the pressure between the honing stones of a honing assembly and the internal surface of a cylindrical member, said honing assembly including a wheel member for adjusting the stones and a motor for rotating the honing stones, said load sensing system comprising:

a brake assembly associated with said wheel member;

means for sensing the load on said motor when said motor is rotating;

means for activating said brake assembly in response to said sensing means sensing a first predetermined and presetable load on said motor; and means for de-activating said brake assembly in response to said sensing means sensing a second predetermined and presetable load on said motor.

* * * * *